US007948353B2

(12) United States Patent
Deno et al.

(10) Patent No.: US 7,948,353 B2
(45) Date of Patent: May 24, 2011

(54) POWER-CIRCUIT BREAKING DEVICE

(75) Inventors: Masahiro Deno, Makinohara (JP); Yasukazu Chikamatsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 20 days.

(21) Appl. No.: 12/213,636

(22) Filed: Jun. 23, 2008

(65) Prior Publication Data

US 2009/0033453 A1 Feb. 5, 2009

(30) Foreign Application Priority Data

Jul. 31, 2007 (JP) ..... 2007-199441

(51) Int. Cl.
*H01H 85/50* (2006.01)
*H01H 85/20* (2006.01)

(52) U.S. Cl. ..... 337/205; 337/187; 337/194; 361/835; 361/837

(58) Field of Classification Search ..... 337/205, 337/255, 187, 194; 361/835, 837
See application file for complete search history.

(56) References Cited

U.S. PATENT DOCUMENTS

| | | | | | |
|---|---|---|---|---|---|
| 1,966,716 | A | * | 7/1934 | Green | 337/194 |
| 2,204,948 | A | * | 6/1940 | Pond | 337/226 |
| 3,432,789 | A | * | 3/1969 | Poehlman , Jr. | 337/242 |
| D298,123 | S | * | 10/1988 | Beard | D13/161 |
| 5,416,461 | A | * | 5/1995 | Totsuka et al. | 337/261 |
| 5,700,165 | A | * | 12/1997 | Harris et al. | 439/620.26 |
| 5,739,739 | A | * | 4/1998 | Muramatsu et al. | 337/234 |
| 5,775,940 | A | * | 7/1998 | Tanigawa | 439/507 |
| 5,841,337 | A | * | 11/1998 | Douglass | 337/198 |
| 5,859,580 | A | * | 1/1999 | Hashizawa et al. | 337/260 |
| 5,973,418 | A | * | 10/1999 | Ciesielka et al. | 307/130 |
| 6,054,915 | A | * | 4/2000 | Rowton et al. | 337/216 |
| 6,157,287 | A | * | 12/2000 | Douglass et al. | 337/198 |
| 6,587,028 | B2 | * | 7/2003 | Mollet et al. | 337/194 |
| 6,784,783 | B2 | * | 8/2004 | Scoggin et al. | 337/194 |
| 2002/0080005 | A1 | * | 6/2002 | Mollet et al. | 337/255 |
| 2004/0192113 | A1 | * | 9/2004 | Yamashita et al. | 439/621 |
| 2008/0242150 | A1 | * | 10/2008 | Chikamatsu et al. | 439/620.3 |

FOREIGN PATENT DOCUMENTS

JP 10-083753 3/1998

* cited by examiner

*Primary Examiner* — Anatoly Vortman
(74) *Attorney, Agent, or Firm* — Edwards Angell Plamer & Dodge LLP

(57) ABSTRACT

A power-circuit breaking device, which can easily mount a fuse and has a small number of component and a simple structure. The power-circuit breaking device includes a first connector housing having a pair of circuit terminals connected with a power circuit, and a second connector housing closing the power circuit by fitting with the first connector housing. The second connector housing includes a fuse having a pair of terminals to be connected with the pair of circuit terminals, a housing having a lock arm engaged with a cutout provided at the terminal and a cover an entry opening of a receiving section of the housing. The cover includes a limiter limiting the lock arm to move to disengaging the terminal.

8 Claims, 8 Drawing Sheets

POWER-CIRCUIT BREAKING DEVICE

The priority application Number Japan Patent Application 2007-199441 upon which this patent application is based is hereby incorporated by reference.

BACKGROUND OF THE INVENTION

1. Field of the Invention

This invention relates to a power-circuit breaking device (service plug) for breaking a current flow by opening a power circuit.

2. Description of the Related Art

Because capacity of a power source such as a battery in an electric vehicle is greater than that in a normal vehicle with a gasoline engine, it is required for safety in working to open the power circuit by using a power-circuit breaking device (service plug) when maintaining an electric system. Such power-circuit breaking device in the prior art is generally presented by a power-circuit breaking device 101 shown in FIGS. 7, 8 (Refer Patent Document 1: Japan Patent Published Application No. H10-83753).

The power-circuit breaking device 101, as shown in FIG. 7, includes a first connector housing 102 having a pair of female terminals 120 connected to a terminal portion of an open power circuit and a second connector housing 103 for electrically connecting the pair of female terminals 120 to each other. The second connector housing 103 includes a pair of male terminals 130 connected with the pair of female terminals 120, a fuse 140 arranged between the pair of male terminals 130 and a housing 144 receiving the pair of male terminals 130 and the fuse 140.

The fuse 140 includes a fuse element received in a plastic fuse body 141 and a pair of metallic tabs 142 having one end portion thereof connected to the fuse element and the other end portion thereof projecting outwardly from the fuse body 141. As shown in FIG. 8, the pair of male terminals 130 is inserted through holes provided at the other end portions of the metallic tabs 142, and screwed with nuts 143 so that the fuse 140 is jointed integrally with the pair of male terminals 130.

According to such power-circuit breaking device 101, the first connector housing 102 and the second connector housing 103 are connected to each other so that the female terminals 120 and the male terminals 130 are fitted together so as to close the power circuit. Inversely, by releasing fitted terminals, the power circuit is opened. When an overcurrent flows through the close power circuit, the fuse element of the fuse 140 would be blown out so as to open the power circuit and break the current flow.

SUMMARY OF THE INVENTION

The above power-circuit breaking device 101 is required to have a structure for fixing the pair of male terminals 130 and the metallic tabs 142 of the fuse 140 and a structure for fixing the male terminals 130 jointed with the fuse 140 on the housing 144. Therefore, the number of components is large and the number of process steps is large.

According to the above problems, an object of the present invention is to provide a power-circuit breaking device, which can easily fix a fuse inside thereof and reduce the number of components and have a simple structure.

In order to overcome the above problems and attain the object of the present invention, a power-circuit breaking device according to the present invention includes a first connector housing having a pair of circuit terminals connected with an open power circuit; and a second connector housing closing the power circuit by connecting with the first connector housing, wherein the second connector housing includes a fuse having a pair of terminals to be connected with the pair of circuit terminals; a housing having a receiving section for receiving the fuse and a lock member locking the fuse, the lock member arranged in the receiving section; and a cover covering an opening of the receiving section of the housing, and the cover includes a limiter functioning to prohibit the lock member from displacing to unlock the locked fuse when the cover is mounted on the housing.

The power-circuit breaking device according to the present invention is further characterized in that the lock member includes a plate portion extending along a direction of inserting the fuse into the receiving section, and having one end of the plate portion along the direction of inserting as a fixed end and the other end of the plate portion along the direction of inserting as a free end; and a projecting portion projecting from the other end toward the fuse and lock the fuse, and the limiter is formed into a plate shape extending along the direction of inserting, and the plate portion of the lock member is positioned between the fuse and the limiter so as to prohibit the plate portion of the lock member from bending to move apart from the fuse when the cover is mounted on the housing.

The power-circuit breaking device according to the present invention is further characterized in that the fuse includes a cylindrical fuse body receiving a fuse element; and a pair of terminals having one end portions received in the fuse body so as to be connected with the fuse element and the other end portions arranged outside the body, and each one of the pair of terminals includes a bent corner provided by forming the terminal portion so as to cross the one end portion and the other end portion perpendicular to each other, the bent corner including a cutout to be engaged with the lock member.

The power-circuit breaking device according to the present invention is further characterized in that the housing and the cover further include a cover lock set locking the housing and the cover.

According to the power-circuit breaking device of the present invention, the housing includes the lock member for locking the fuse, so that the fuse can be mounted easily on the housing by press-fitting the fuse into the housing. It is possible to provide a power-circuit breaking device which has a smaller number of components and has a simpler structure. Completion of fixing the fuse on the housing can be recognized by seeing locking of the lock member and the fuse. Furthermore, since the cover has a limiter functioning to prohibit the lock member from displacing to unlock the locked fuse when the cover is mounted on the housing, it can be prevented that the fuse falls out of the housing. Thus, with a smaller number of components and a simpler structure, the fuse can be securely fixed on the housing.

According to the power-circuit breaking device of the present invention, completion of locking the fuse on the housing can be recognized by normal mounting of the lock member and the fuse.

According to the power-circuit breaking device of the present invention, the lock member is engaged into the cutout arranged at the bent corner of each terminal portion. Therefore, the lock member holds the terminal portion in a direction perpendicular to a cross section of the terminal portion so that the fuse can be held in the housing without deformation of the terminal portion.

According to the power-circuit breaking device of the present invention, the housing and the cover further include the cover lock set locking to each other. Thus, an internal structure of the housing can be simplified so that a molding die for the housing can be simplified.

The above and other objects and features of this invention will become more apparent from the following description taken in conjunction with the accompanying drawings.

DESCRIPTION OF AN EXEMPLARY EMBODIMENT

A power-circuit breaking device (so-called service plug) of one embodiment according to the present invention will be described with reference to FIGS. 1-6. The power-circuit breaking device 1 of the embodiment is applied into a power circuit for supplying electric power from a battery in an electric vehicle to a load apparatus so as to open and close the power circuit according to requirements.

Figure 1:
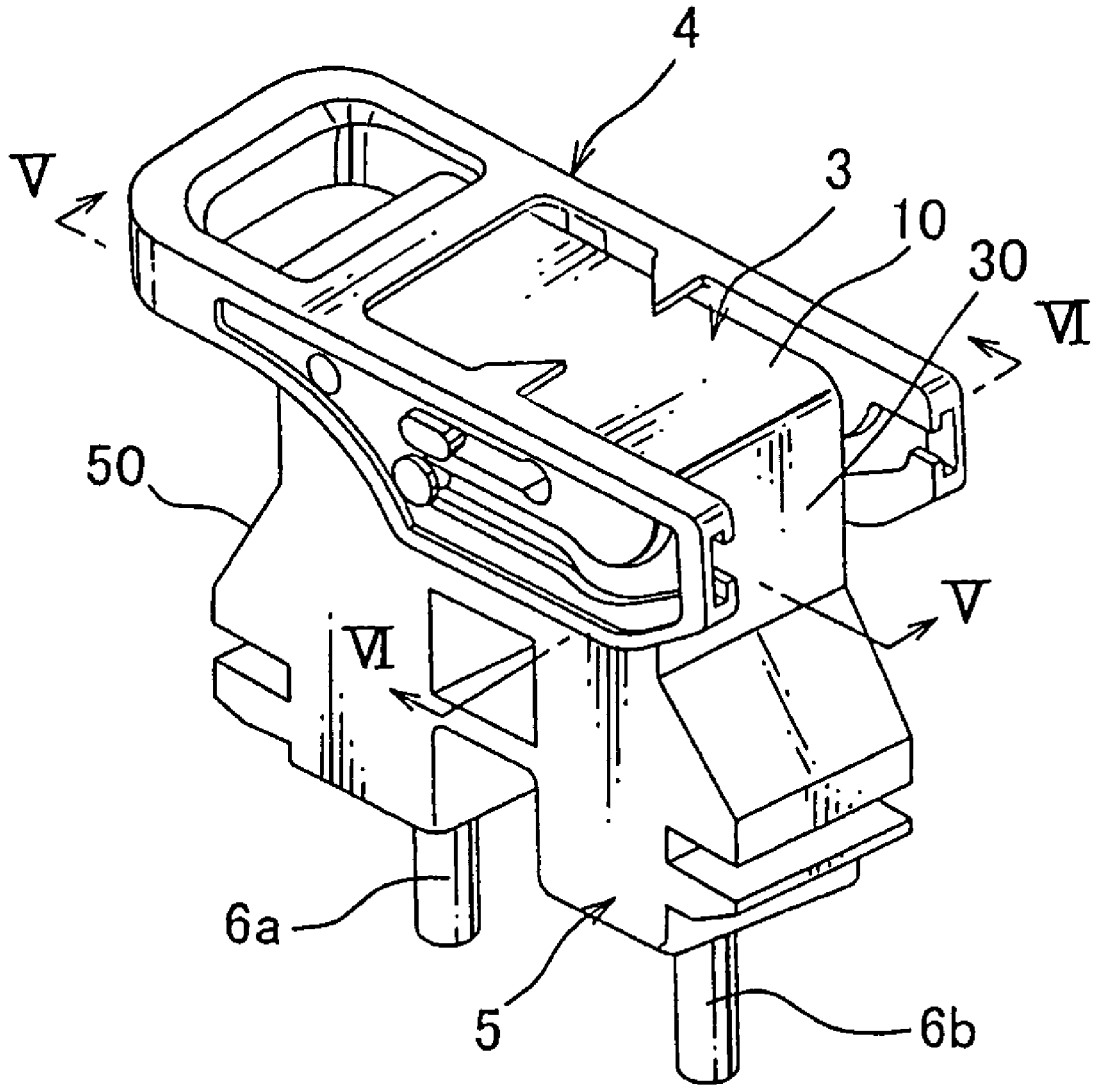
FIG. 1 is a perspective view of a power-circuit breaking device of an embodiment according the present invention.
Figure 2:
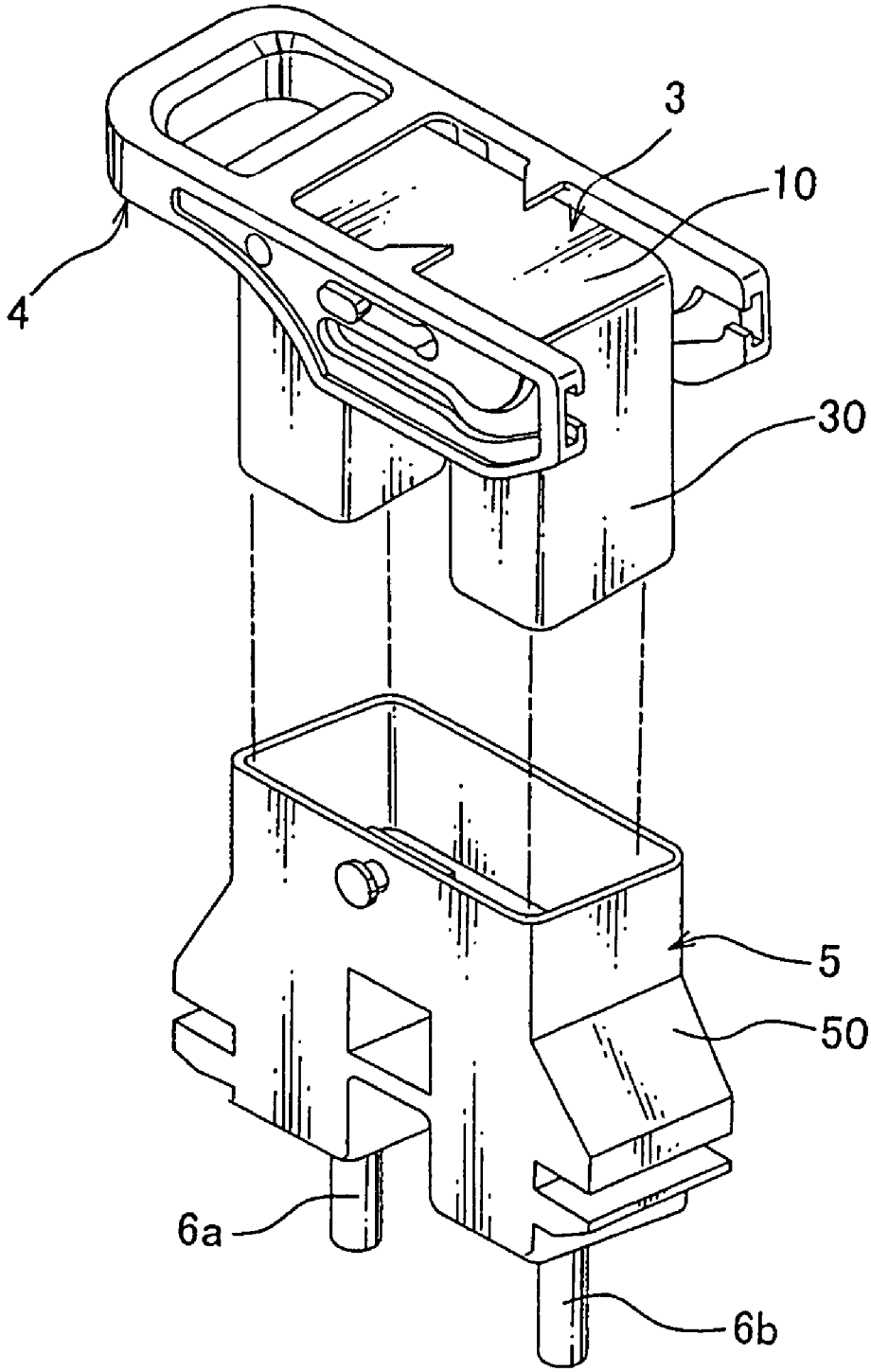
FIG. 2 is an exploded perspective view of the power-circuit breaking device shown in FIG. 1.

The power-circuit breaking device 1, as shown in FIGS. 1 and 2, includes a first connector housing 5, a plastic lever 4 and a second connector housing 3 connecting/disconnecting with the first connector housing 5 by operation of the lever 4.

The second connector housing 3 includes a plastic housing 30, a fuse 2 including a later-described fuse body 21 and a later-described pair of terminals 22 and press-fitted into a receiving section 7 of the housing 30, and a plastic cover 10 covering an entry opening of the receiving section 7.

Figure 5:
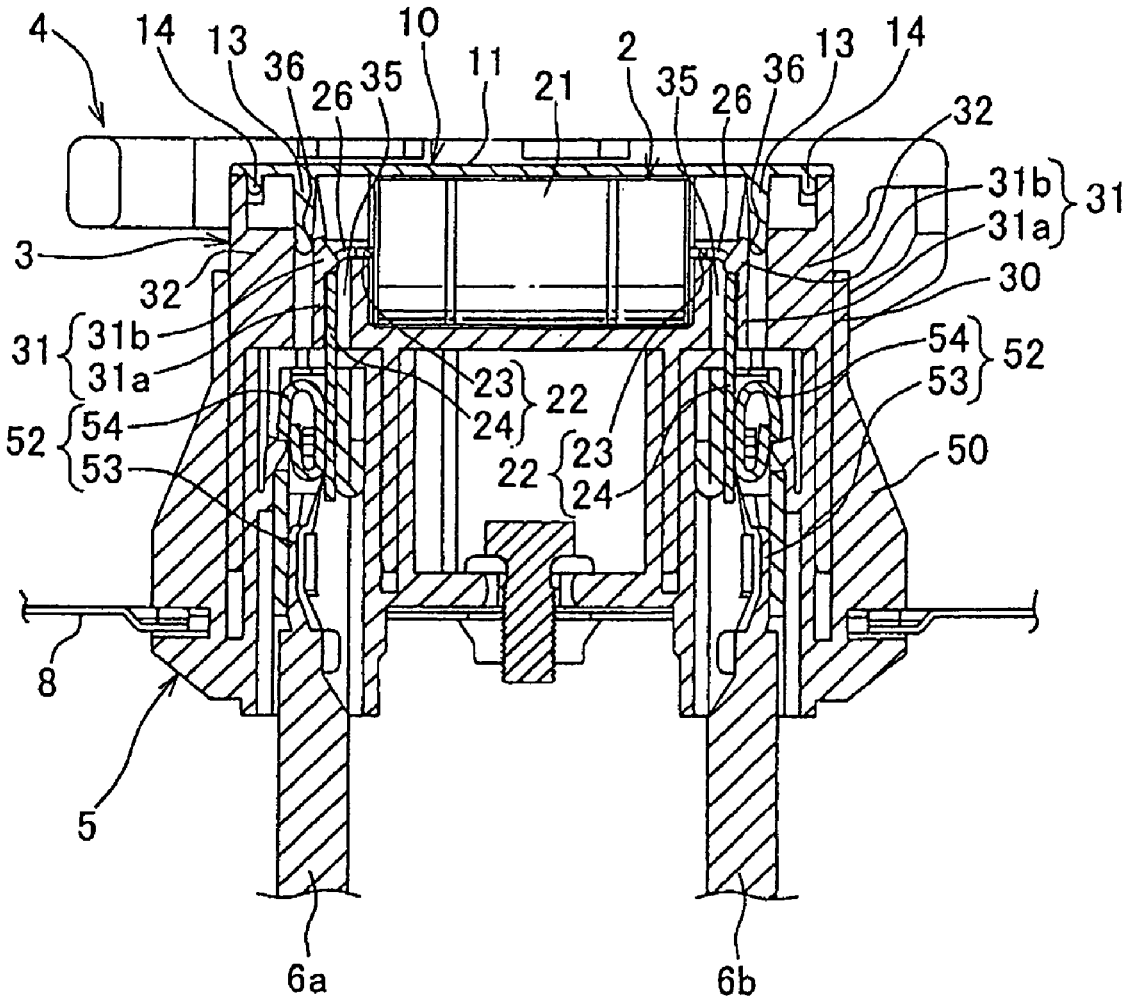
FIG. 5 is a cross-sectional view taken along the line V-V in FIG. 1.

The first connector housing 5, as shown in FIG. 5, includes a main body 50 and a pair of circuit terminals 52 received in the main body 50. The main body 50 is fixed at a flange 8 of the vehicle.

The pair of circuit terminals 52 formed with an electric conductive sheet metal includes a wire joint portion 53 connected with an electric wire by crimping and an electric contact 54 press-fitted with the terminal 22 of the fuse 2. The electric contact 54 has a tube portion formed into a rectangular tube for receiving the terminal 22 inside thereof and a pushing member arranged in the tube portion for pushing the terminal 22 toward a wall of the tube portion. The wire joint portion 53 of one of the pair of circuit terminals 52 is jointed with an end of an electric wire 6*a* connected with the battery. The wire joint portion 53 of the other of the pair of circuit terminals 52 is jointed with an end of an electric wire 6*b* connected with the load apparatus. The pair of circuit terminals 52 is arranged at an interval to each other. When the pair of circuit terminals 52 is electrically connected to each other, the power circuit is closed, and when the pair of circuit terminals 52 is electrically disconnected from each other, the power circuit is opened.

A lever 4 is provided rotatably on an outer surface of the housing 30. By rotating the lever 4, the housing 30 is moved along a direction of inserting the housing 30 into the main body 50 to be close to or apart from the main body 50 between a fitting position, in which the housing 30 is received in the main body 50 of the first connector housing 5, and a removing position, in which the housing 30 is positioned out of the main body 50.

Figure 3:
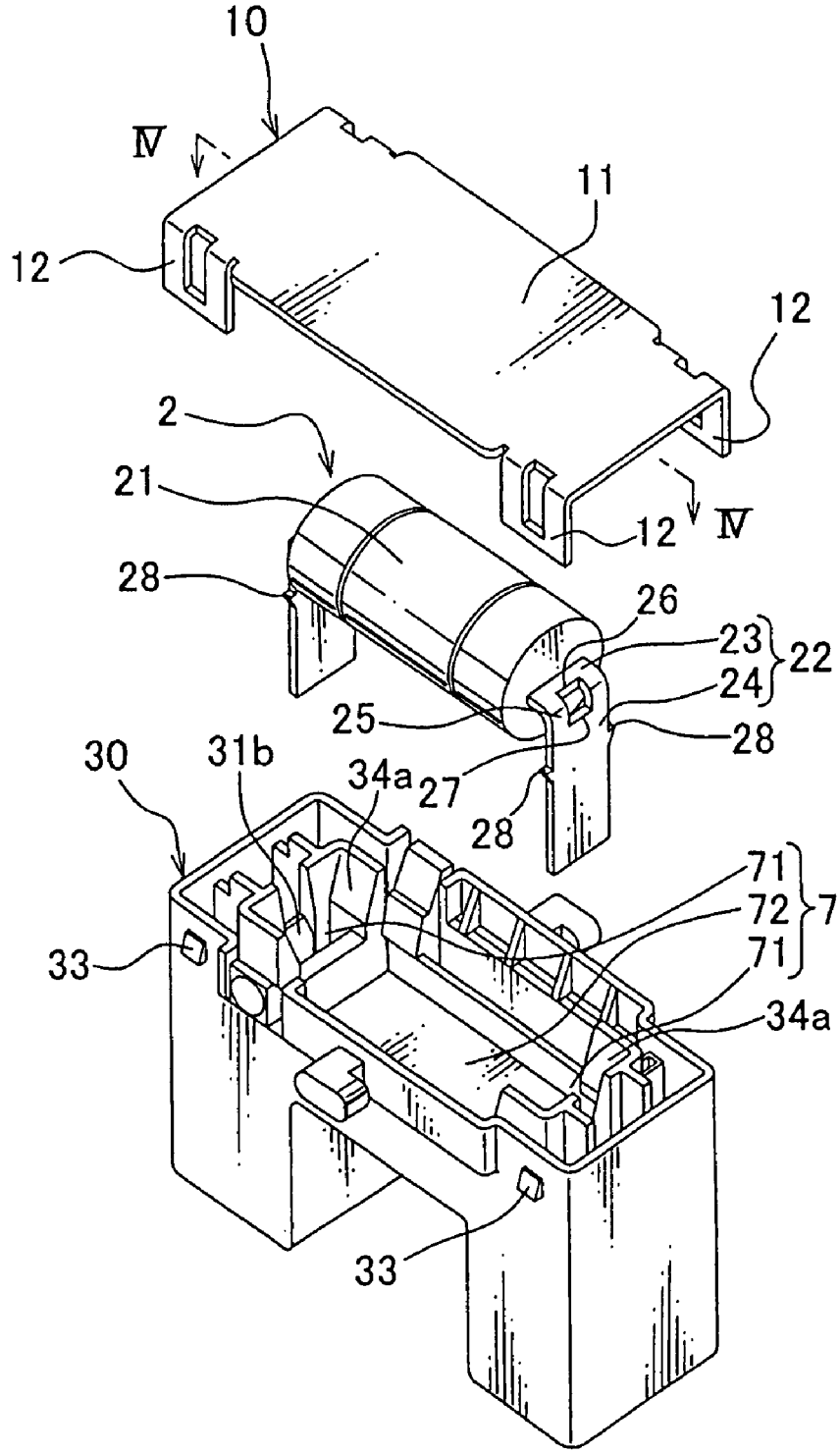
FIG. 3 is an exploded perspective view of a second connector housing structuring the power-circuit breaking device shown in FIG. 2.
Figure 4:
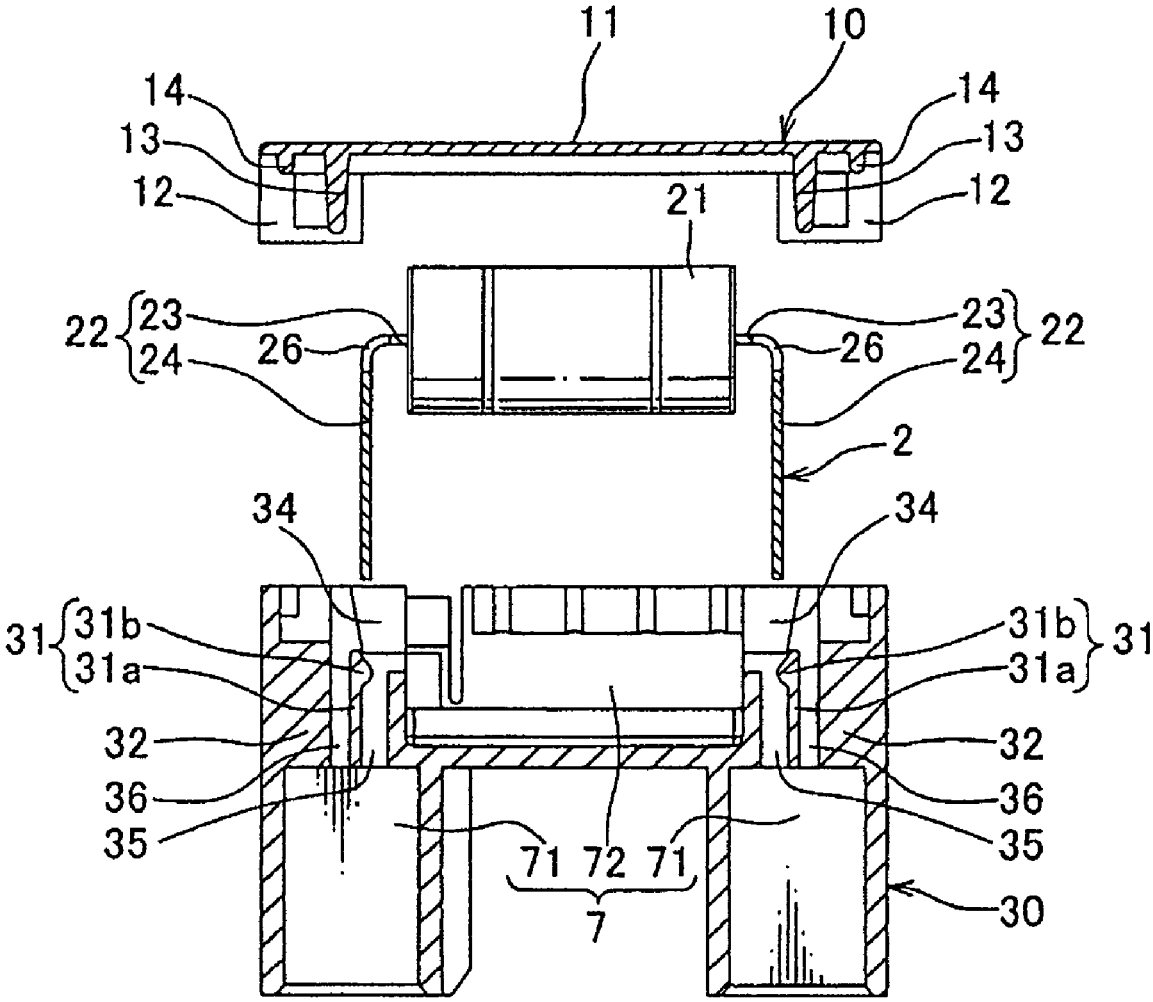
FIG. 4 is a cross-sectional view taken along the line IV-IV in FIG. 3.

The receiving section 7, as shown in FIGS. 3 and 4, includes a pair of first sections 71 arranged at an interval along a direction perpendicular to the direction of inserting and having an opening facing to the main body 50 and extending along the direction of inserting, and a second section 72 arranged between the pair of first sections 71 and having an opening facing oppositely to the opening of the first section 71 and extending along the direction perpendicular to the direction of inserting.

The fuse 2 is inserted into the housing 30 through the opening of the second-section 72, that is the entry opening of the receiving section 7 along the direction of inserting. When the fuse 2 is press-fitted in the housing 30, the pair of terminals 22 of the fuse 2 is positioned in the first sections 71 and the fuse body 21 is positioned in the second section 72.

When the circuit terminal 52 is inserted into the first section 71, the terminal 22 of the fuse 2 is inserted into the electric contact 54 of the circuit terminal 52 so as to be electrically connected to each other. Thus, by electrically connecting the pair of circuit terminals 52, the power circuit is closed.

The housing 30 includes, in each of the pair of first sections 71, a pair of lock arms 31 as a locking member, a stopper 32 preventing the lock arm 31 from displacing unexpectedly, and a pair of guide walls 34 guiding each of the pair of terminals 22 of the fuse 2 into a deep side of the first section 71.

The pair of lock arms 31 includes a plate portion 31*a* extending along a direction of inserting the terminal 22 into the first section 71, the same as the direction of inserting the housing 30 into the main body 50, and a projecting portion 31*b* engaging with a later-described cutout 26 of the fuse 2.

One end, as a fixed end, of the plate portion 31*a*, near side to the main body 50 along the direction of inserting, is continued to an outer wall of the housing 30. The other end, as a free end, of the plate portion 31*a*, far side to the main body 50 along the direction of inserting, is movable in a direction perpendicular to the direction of inserting. The terminal 22 is positioned in an inner section 35 of the first section 71 inside the plate portion 31*a* toward the center of the second section 72.

The projecting portion 31*b* is continued to the other end of the plate portion 31*a* and projecting toward the inner section 35. The projecting portion 31*b* is engaged with the cutout 26 provided at the terminal 22 of the fuse 2. Thus, the terminal 22, that is the fuse 2, is prevented from falling out of the housing 30.

The stopper 32 is arranged in the first section 71 outside the plate portion 31*a* from the center of the second section 72 so as to generate a gap between the plate portion 31*a* and itself. When the terminal 22 of the fuse 2 is inserted into the inner section 35 slantingly against the direction of inserting, such stopper 32 abuts on the plate portion 31*a* and prevents the plate portion 31*a* from over-displacing toward the stopper 32, that is outwardly from the housing 30. A later-described limiter 13 of the cover 10 is positioned between a section 36 between the stopper 32 and the plate portion 31*a*.

Figure 6:
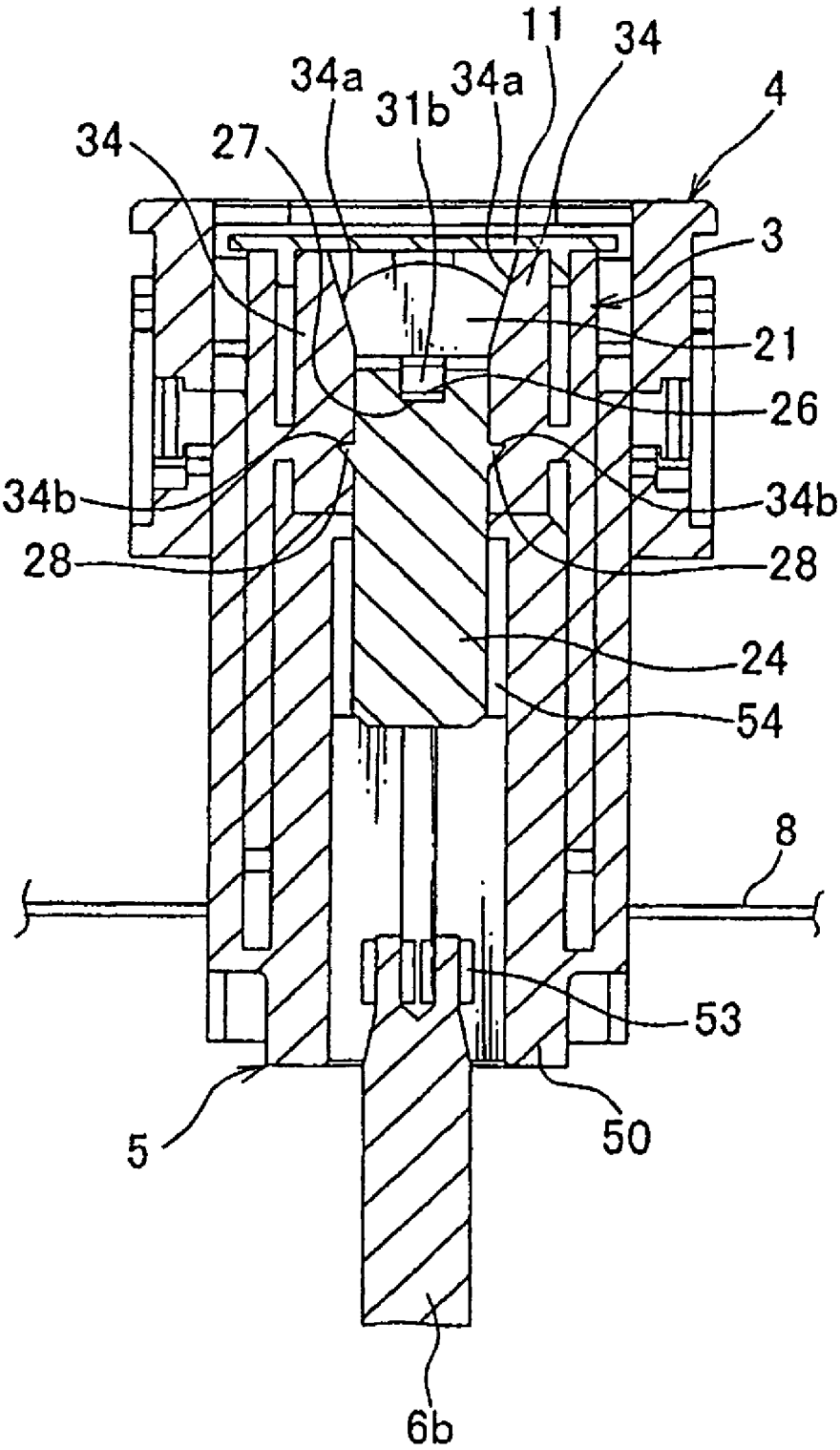
FIG. 6 is a cross-sectional view taken along the line VI-VI in FIG. 1.
Figure 7:
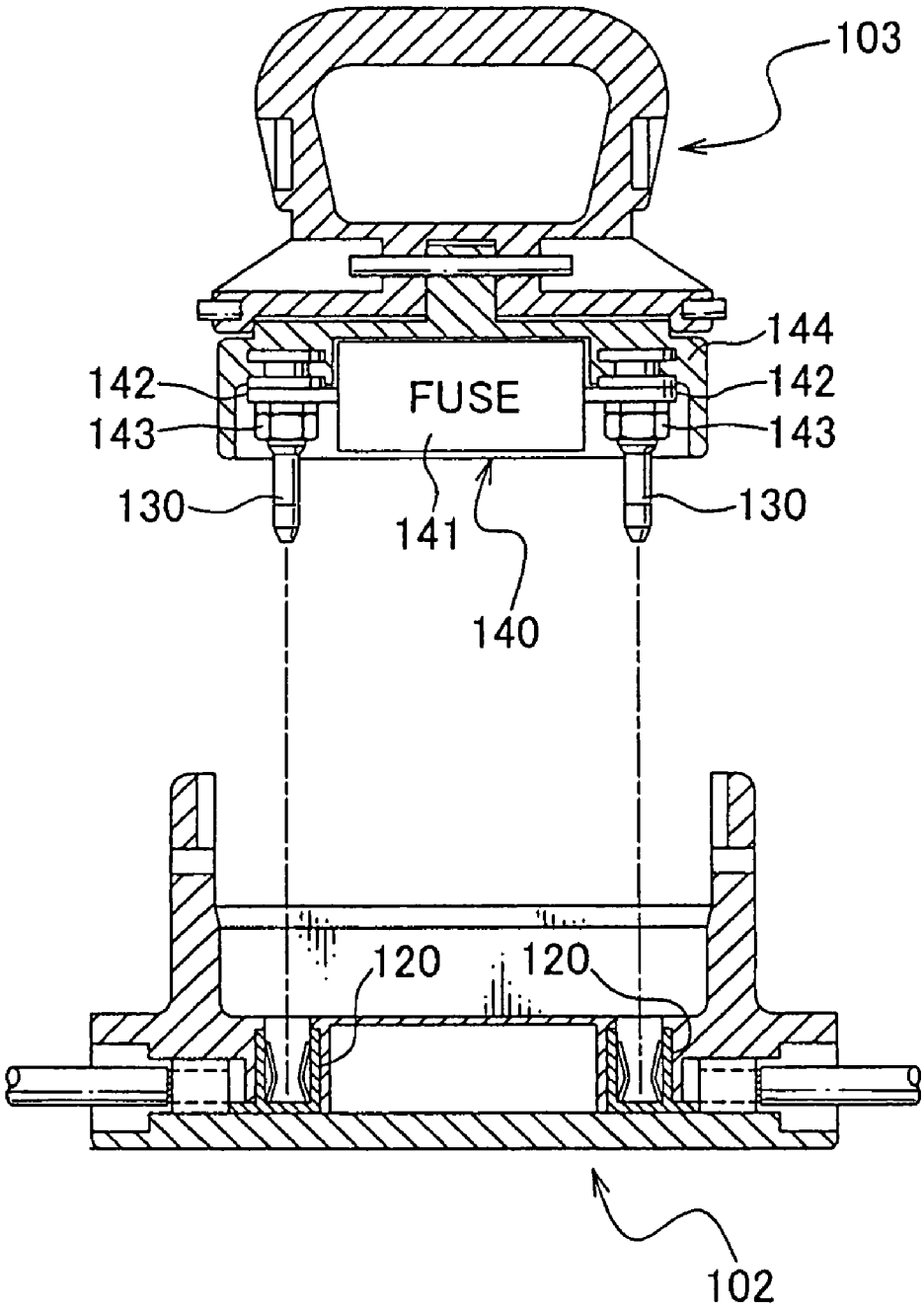
FIG. 7 PRIOR ART
FIG. 7 is a cross-sectional view of a power-circuit breaking device by prior art.
Figure 8:
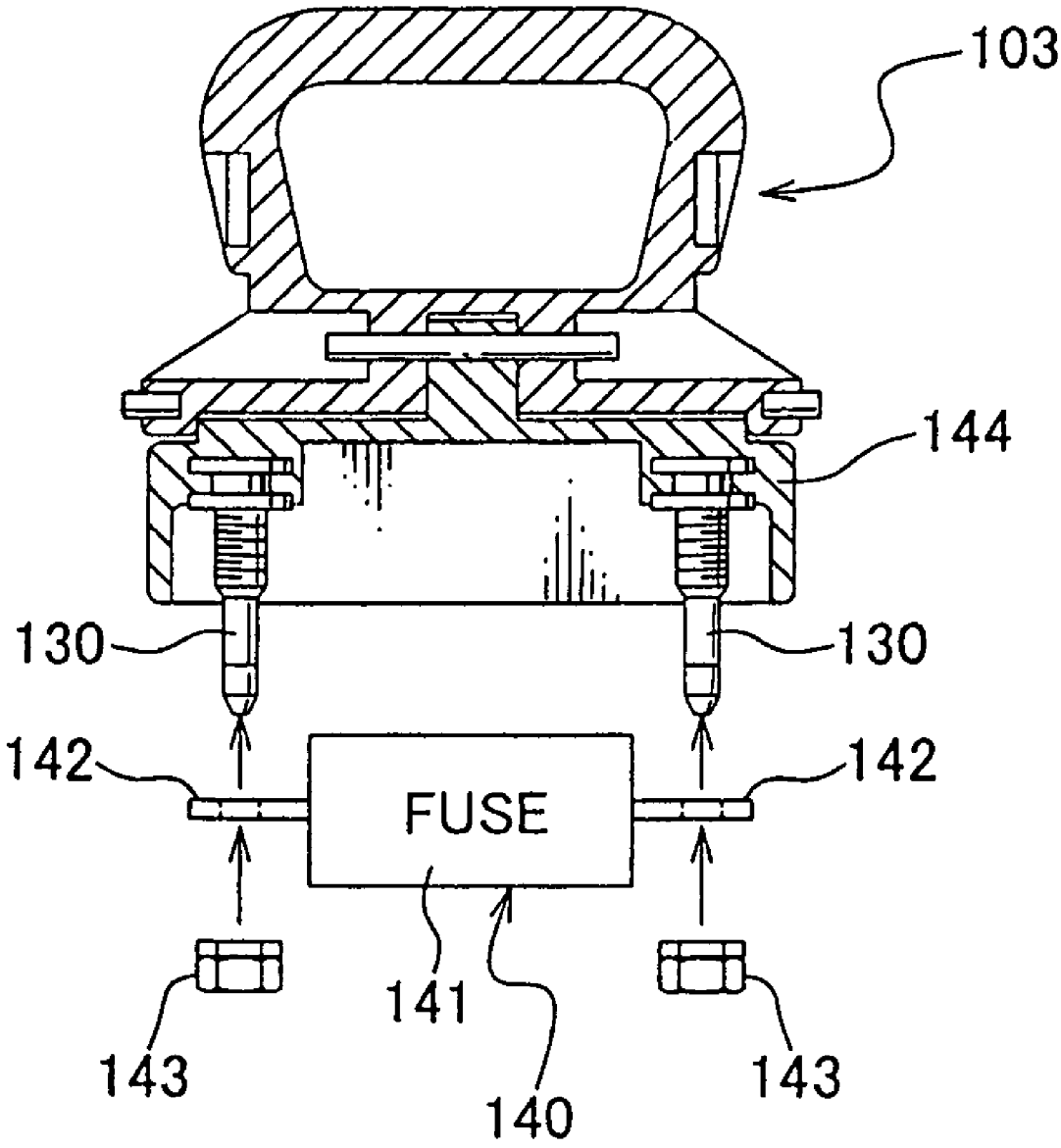
FIG. 8 PRIOR ART
FIG. 8 is a cross-sectional view showing assembling process of the power-circuit breaking device shown in FIG. 7.

The pair of guide walls 34, as shown in FIG. 6, is arranged in the first section 71 at an interval to each other along a traversing direction perpendicular to both of the direction of inserting and the direction perpendicular to the direction of inserting. The pair of guide walls 34 is provided with a pair of tapered surfaces 34*a*, slanted so as to have a narrower distance between the pair of guide walls 34*a* along the direction of inserting. The pair of guide walls 34*a* is formed at a deeper area than the pair of tapered surfaces 34*a* to have a slightly wider width than a width of the terminal 22 of the fuse 2. A pair of recesses 34*b* is provided at a deeper area than the pair of tapered surfaces 34*a* so as to recess on the guide walls 34. The pair of recesses 34*b* is engaged with a pair of nibs 28 provided at each terminal 22.

The terminal 22 is guided toward a deep side of the first section 71 by sliding on the tapered surfaces 34*a* along the direction of inserting. The terminal 22 guided to the deep area of the first section 71 is positioned in a required position so as to be prevented from falling out of the first section 71 by the recesses 34*b*.

Four cover lock sets are provided at the second connector housing 3. One part 33 of the cover lock set is arranged at each of four locations near to the entry opening on the outer surface of the housing 30 and formed into a projection shape projecting from the outer surface of the housing 30. The one part 33 of the cover lock set is engaged with the other part 12 of the cover lock set provided at the cover 10.

The fuse 2 includes the plastic fuse body 21 receiving a fuse element (not shown) and the pair of terminals 22 made of conductive metal sheet. One end portion of the terminal 22 is received in the fuse body 21 so as to be connected with the fuse element. The other end portion of the terminal 22 is arranged outside the fuse body 21.

The terminal 22 includes a bent corner 25 formed so as to cross the one end portion and the other end portion perpendicular to each other. The one end portion has a first surface 23 and the other end portion has a second surface 24.

The one end portions of the pair of terminals 22 are connected through the fuse element to each other. When an overcurrent flows through the fuse 2, the fuse element is blown out and the electric current flowing between the pair of terminals 22 is broken off. The one end portions of the pair of terminals 22 are arranged in the same plane.

The other end portion of the terminal 22 extends along the direction of inserting the fuse 2 into the first section 71. When the second connector housing 3 is fitted into the first connector housing 5, the other end portion is electrically connected with the electric contact 54 of the circuit terminal 52. The other end portion of the terminal 22 has the pair of nibs 28 projecting outwardly from both edges of widthwise of the terminal 22 in the direction perpendicular to the direction of inserting. The pair of nibs 28 is engaged with the pair of recesses 34*b*. Thereby, the fuse 2 is prevented from falling out of the receiving section 7 of the housing 30.

The bent corner 25 is provided at a middle area thereof with the cutout 26 traversing both of the one end portion and the other end portion. The cutout 26 is formed into a rectangular shape to penetrating through the terminal 22. A cross-section 27 of the other end portion exposed by providing the cutout 26 is formed perpendicular to the second surface 24. The cutout 26 is engaged with the projecting portion 31*b* of the lock arm 31. When the cutout 26 is engaged with the projecting portion 31*b*, the projecting portion 31*b* holds the cross-section 27 along the direction of inserting. Thereby, the fuse 2 can be held in the housing 30 without deformation of the terminal 22.

Thus, the nibs 28 are engaged with the recesses 34*b*, and the cutout 26 is engaged with the projecting portion 31*b*, so that the fuse 2 is fixed in the housing 30 and prevented from falling out of the housing 30.

After the fuse 2 is fixed in the housing 30, the cover 10 is mounted on the housing 30 so as to cover the entry opening of the receiving section 7 of the housing 30. The cover 10 includes a cover main body 11 formed into a rectangular plate for covering the entry opening, a pair of limiters 13 projecting from the cover main body 11 in the direction of inserting, four other parts 12 of the cover lock set provided at the outer edge of the cover main body 11 and projecting along the direction of inserting, and a guide rib 14 projecting in the direction of inserting from the cover main body 11.

The pair of limiters 13 is formed into a plate shape so as to project perpendicularly from the cover main body 11. When the cover 10 is mounted on the housing 30, the limiter 13 is positioned in the section 36 between the stopper 32 and the plate portion 31*a* so as to limit the plate portion 31*a* to move closer to the stopper 32, that is to move apart from the cutout 26. When the projecting portion 31*b* is not completely engaged with the cutout 26, the plate portion 31*a* is displaced toward the stopper 32, so that the limiter 13 cannot be inserted into the section 36 and the cover 10 cannot be mounted completely on the housing 30. Oppositely, by confirming that the cover 10 is normally mounted on the housing 30, the projecting portion 31*b* can be securely engaged with the cutout 26.

The four other parts 12 of the cover lock set are formed into a frame shape so as to engage with the four one parts 33 of the cover lock set. Thus, the cover 10 is fixed on the housing 30.

In the power-circuit breaking device 1 structured above, the pair of terminals 22 is received in the electric contact portion 54 of the pair of circuit terminals 52 and electrically connected with each other by rotating the lever 4 and fitting the second connector housing 3 into the first connector housing 5 as shown in FIG. 1. Thereby, the electric wires 6*a*, 6*b* connected respectively with the pair of circuit terminals 52 close the power circuit through the fuse 2. When the overcurrent flows in the power circuit, the fuse element of the fuse 2 is blown out so as to break the current flowing in the power circuit.

For maintaining the power circuit with the power-circuit breaking device 1 or repairing the fuse 2, the second connector housing 3 is removed from the first connector housing 5 by rotating the lever 4 in a counter direction to the direction of fitting. Thereby, the pair of terminals 22 of the second connector housing 3 and the pair of circuit terminals 52 are electrically disconnected and the electric wires 6*a*, 6*b* connected with the pair of circuit terminals 52 are electrically disconnected to open the power circuit. Therefore, the power circuit can be acted maintained.

In the embodiment, since the nibs 28 and the recesses 34*b*, and the lock arm and the cutout 26 are provided, thereby the fuse 2 can be mounted in the housing 30 by press-fitting without usual fixing structures, the power-circuit breaking device 1, which can be easily assembled with a small number of components, can be provided.

By confirming visually that the cover 10 is normally mounted on the housing 30, the projecting portion 31*b* can be securely engaged with the cutout 26 and the fuse 2 can be securely fixed in the housing 30.

When the cover 10 is mounted on the housing 30, the limiter 13 of the cover 10 limits the plate portion 31*a* of the lock arm 31 to move to disengage the projecting portion 31*b* and the cutout 26. Thus, the plate portion 31*a* can be prevented from moving after mounting the cover 10 on the housing 30. Thereby, it can be prevented that the fuse 2 falls out of the housing 30.

When the projecting portion 31*b* is not completely engaged with the cutout 26, the limiter 13 cannot be inserted into the section 36 and the cover 10 cannot be mounted completely on the housing 30. By confirming that the cover 10 is normally mounted on the housing 30, the projecting portion 31*b* can be securely engaged with the cutout 26.

Because the cover lock set 12, 33 is provided at the housing 30 and the cover 10, the inner structure of the housing 30 can be simplified. Thereby, a tooling for manufacturing the housing 30 can be simplified and a cost for the housing 30 can be reduced.

Because the housing 30 includes the pair of guide walls 34 guiding the terminals 22 toward the deep area of the first section of the first section 71 and positioning the terminals 22, productivity of assembling the fuse 2 in the housing 30 can be improved.

Because the projecting portion 31*b* holds the cross-section 27 of the terminal 22 in the direction of the plane of the terminal 22, the terminal 22 can be held in the housing without deformation.

When the second connector housing 3 is inserted into the first connector housing 5, that is the terminal 22 is fitted into the electric contact 54 of the circuit terminal 51, a fitting force to push the terminal 22 up from the housing 30 is generated at a contact point of the terminal 22 and the electric contact 54. However, the projecting portion 31*b* holds the cross-section 27 of the cutout 26 just above the contact point downwardly, so that the terminal 22 can be held in the housing 30 without deformation.

While, in the embodiment, the present invention is described, it is not limited thereto. Various change and modifications can be made with the scope of the present invention.

The invention claimed is:

1. A power-circuit breaking device, comprising:

a first connector housing having a pair of circuit terminals connected with an open power circuit; and a second connector housing closing the power circuit by connecting with the first connector housing, wherein the second connector housing comprises:

a fuse having a pair of terminals to be connected with the pair of circuit terminals;

a housing having a receiving section for receiving the fuse, a lock member locking the fuse, the lock member arranged in the receiving section, and a stopper preventing the locking member from displacing unexpectedly, the locking member being movable closer to the stopper; and a cover covering an opening of the receiving section of the housing, wherein the cover comprises a limiter functioning to prohibit the lock member from displacing to unlock the locked fuse by positioning the limiter in a section between the stopper and the lock member when the cover is mounted on the housing, and wherein the fuse comprises:

a cylindrical fuse body receiving a fuse element; and a pair of terminals having one end portions received in the fuse body so as to be connected with the fuse element and the other end portions arranged outside the fuse body.

2. The power-circuit breaking device according to claim 1, wherein the lock member comprises:

a plate portion extending along a direction of inserting the fuse into the receiving section, and having one end of the plate portion along the direction of inserting as a fixed end and the other end of the plate portion along the direction of inserting as a free end; and a projecting portion projecting from the other end toward the fuse and locking the fuse, wherein the limiter is formed into a plate shape extending along the direction of inserting, wherein the plate portion of the lock member is positioned between the fuse and the limiter so as to prohibit the plate portion of the lock member from bending to move apart from the fuse when the cover is mounted on the housing.

3. The power-circuit breaking device according to claim 1, wherein each one of the pair of terminals comprises a bent corner provided by forming the terminal so as to cross the one end portion and the other end portion perpendicular to each other, the bent corner comprising a cutout to be engaged with the lock member.

4. The power-circuit breaking device according to claim 1, wherein the housing and the cover further comprise a cover lock set locking the housing and the cover.

5. The power-circuit breaking device according to claim 2, wherein each one of the pair of terminals comprises a bent corner provided by forming the terminal so as to cross the one end portion and the other end portion perpendicular to each other, the bent corner comprising a cutout to be engaged with the lock member.

6. The power-circuit breaking device according to claim 2, wherein the housing and the cover further comprise a cover lock set locking the housing and the cover.

7. The power-circuit breaking device according to claim 3, wherein the housing and the cover further comprise a cover lock set locking the housing and the cover.

8. The power-circuit breaking device according to claim 5, wherein the housing and the cover further comprise a cover lock set locking the housing and the cover.

* * * * *